US005660343A

United States Patent [19]

Schippers et al.

[11] Patent Number: 5,660,343

[45] Date of Patent: Aug. 26, 1997

[54] METHOD OF MARKING THE END OF A YARN WOUND ON A PACKAGE AND APPARATUS FOR CARRYING OUT THE METHOD

[75] Inventors: Heinz Schippers, Remscheid; Hans-Gerhard Hutter, Leverkusen, both of Germany

[73] Assignee: Barmag AG, Remscheid, Germany

[21] Appl. No.: 454,127

[22] PCT Filed: Jan. 11, 1994

[86] PCT No.: PCT/DE94/00017

§ 371 Date: Sep. 1, 1995

§ 102(e) Date: Sep. 1, 1995

[87] PCT Pub. No.: WO95/15907

PCT Pub. Date: Jun. 15, 1995

[30] Foreign Application Priority Data

Dec. 9, 1993 [DE] Germany ..... 43 41 974.7

[51] Int. Cl.[6] ..... B65H 55/00; B65H 54/00; B65H 75/28

[52] U.S. Cl. ..... 242/172; 242/173; 242/18 EW; 242/125.2

[58] Field of Search ..... 242/18 EW, 172, 242/173, 18 R, 125.2; 156/221, 226, 166, 171, 169

[56] References Cited

U.S. PATENT DOCUMENTS

| | | | |
|---|---|---|---|
| 3,667,492 | 6/1972 | Ueda et al. | 242/164 |
| 3,907,217 | 9/1975 | Graf et al. | 242/18 PW |
| 4,138,072 | 2/1979 | Aoyama et al. | 242/18 EW X |
| 4,736,898 | 4/1988 | Raasch et al. | 242/18 EW |
| 4,760,969 | 8/1988 | Otoshima et al. | 242/18 R |
| 5,332,170 | 7/1994 | Dittly | 242/18 EW |
| 5,425,509 | 6/1995 | Van Severen et al. | 242/18 EW X |
| 5,426,929 | 6/1995 | Schwalm et al. | 242/18 EW X |

FOREIGN PATENT DOCUMENTS

| | | |
|---|---|---|
| 0 542 672 | 5/1993 | European Pat. Off. . |
| 0 559 041 | 9/1993 | European Pat. Off. . |
| 1 760 243 | 12/1971 | Germany . |
| 25 06 930 | 9/1976 | Germany . |
| 37 36 191 | 2/1990 | Germany . |
| 40 23 291 | 5/1992 | Germany . |
| 43 21 278 | 1/1994 | Germany . |
| 1 532 494 | 11/1978 | United Kingdom . |
| 1 558 808 | 1/1980 | United Kingdom . |

*Primary Examiner*—Michael Mansen

*Attorney, Agent, or Firm*—Bell, Seltzer, Park & Gibson, P.A.

[57] ABSTRACT

This invention relates to marking the yarn end of a package, which is wound at the end of a winding cycle over a narrow axial range of the package surface in the form of a yarn bead. For purposes of marking the yarn end (105) of the package (103), a marking strip (126) is used, over which the yarn (105) is wound. A winding mandrel (107) engages into the space between a yarn suction device (106) and the circumferential surface of the package, and is rotated oppositely to the direction of unwinding (112) of the package (103), thereby forming a yarn loop (110) with more than one winding. Inserted axially into the space between winding mandrel (107) and the circumferential surface of the package is the marking strip (126), over which the yarn is wound several times by reversing the rotation of the winding mandrel (107). The excessive yarn (105) of the yarn loop (110) is sucked into the yarn suction device (106), and subsequently the yarn end (105) is cut.

25 Claims, 5 Drawing Sheets

METHOD OF MARKING THE END OF A YARN WOUND ON A PACKAGE AND APPARATUS FOR CARRYING OUT THE METHOD

BACKGROUND OF THE INVENTION

This invention relates to a method of marking the end of a yarn wound on a package and an apparatus for carrying out the method.

In the spinning of synthetic fibers, in particular in the automated spinning process it has in the past been very difficult to mark on the package the free yarn end, so as to be able to easily relocate it in the further processing. Attempts which have become known from the prior art, namely to mark, when winding an endless yarn, the end of the yarn upon completion of a winding cycle, so that it can easily be relocated, have not been satisfactory.

Known, for example, from DE-OS 1 760 243 is a method, which facilitates the relocating of the free yarn end of a cross-wound package, in that at the end of the winding cycle, a certain yarn length is wound uncrossed as a yarn reserve in the region of the head end of the cross-wound package. Although this method allows to reduce the search for the yarn end to a narrow axial section of the package, on which the yarn end is wound, the locating of the yarn, however, continues to present problems.

A method known from DE 40 23 291 A1 facilitates the locating of the yarn end of a cross-wound package in that for the formation of a yarn reserve after reaching a certain package diameter or after winding a certain amount of yarn, the yarn is guided across the package surface onto the tube, or as a secant across the end surface of the package, and subsequently returned to the package surface.

Likewise, according to the method described in DE 25 06 930 A1, a yarn reserve is formed at the end of the winding cycle. To this end, the package is removed from the takeup device and slowly rotated oppositely to the direction of winding, with the yarn end being pneumatically grasped and sucked off by a yarn suction device. Subsequently, the opening of the yarn suction device swings toward an end of the winding tube projecting from the package, whereupon the yarn is delivered to or blown by the suction device into the winding tube, or it is wound about the end of the winding tube, in that the package is again rotated in the direction of winding.

A further known method provides that, for purposes of marking the yarn end, same is tangled or interlaced with one or more previously wound layers of yarn by a blow nozzle, in particular, an entanglement nozzle which is arranged perpendicularly to the package surface and at a narrow distance therefrom.

It is the object of this invention to mark the free yarn end of a package upon completion of the winding cycle such that it is easy to relocate in the further handling of the package. In a further development of the invention, the marking of the yarn end is to occur such that same is simultaneously protected against an accidental unwinding or the like. A further object of the invention is to provide a suitable apparatus for carrying out the method.

SUMMARY OF THE INVENTION

The above and other objects and advantages of the present invention are achieved by the provision of a yarn winding method and apparatus which comprises the steps of winding an advancing yarn onto a rotating core so as to form a wound package having an outer surface, terminating the rotation of the wound package, unwinding a limited length of the yarn from the wound package, then applying a marking strip onto the outer surface of the wound package, and rewinding the limited length of the yarn back onto the package and so as to at least in part overlie the marking strip.

The marking strip permits the yarn end of the package to be clearly identified, and to be easily relocated.

In a further development for packages with a small diameter, the yarn end is sucked into a yarn suction device, thereafter pulled out therefrom by driving the package, and again wound over the marking strip. In this procedure, the marking strip may be applied in front of or behind the suction device.

In a further embodiment, a marking strip is placed from the one end of the package (front end)—preferably slightly projecting beyond the package end—onto the package surface such that it extends beyond the contact range of the yarn end, and that after winding the yarn thereover, its portion extending beyond the wound range is folded toward the package end. Preferred is that the portion of the marking strip extending beyond the contact range is so long that after the folding it extends substantially up to the projecting end of the underlying strip portion.

Advantageously, an adhesive tape may be used as marking strip.

In an advantageous further development, the marking strip is formed to a loop, with the strip ends being glued together to form a pulloff tab, and it is placed onto the suction nozzle of the suction device, before the yarn end is picked up and sucked in. After the limited yarn length has been sucked in, the loop is pushed toward the package surface and placed on same. The yarn is now again wound, in part over the loop forming the marking strip and containing one yarn wind.

In another embodiment of the invention, a one-sided adhesive strip is applied to the package surface with its adhesive side facing outward before rewinding the yarn end. The yarn is then wound thereover. Should the strip have an adequate length, its end extending beyond the wound section may be folded after winding the yarn end thereover, and be glued to the portion of the underlying strip section, which projects from the package end.

In an embodiment of the method in accordance with the invention, which allows the yarn end to be secured to the package at the same time as it is marked, the marking strip is a one-sided adhesive tape.

For example, the marking strip may consist of an adequately strong paper, which permits to withdraw the yarn winds, which lie thereover or are enclosed by it, without incurring the risk of tearing. In a particularly preferred embodiment of the method in accordance with the invention, the marking strip consists of a film strip made of the same polymers as the wound filaments, in particular of a PETP, a PA or PP film strip. The film strip and the unwound yarn layers may then be discarded together as recyclable waste.

In the described embodiments, it has shown to be advantageous, when the yarns winds formed by the yarn end are pressed by suitable attachments.

For yarn packages with diameters of about 500 mm and larger, it has turned out to be difficult or impracticable, because of a considerable entanglement of the yarn end with itself and other waste yarn, which is unavoidable during the suction, to pull out again from the suction device the yarn length of several meters, which is needed for winding over the marking strips.

For the marking of the yarn end of such a package, it is therefore proposed to apply the further step of rotating at least one winding mandrel circumferentially about the wound package at a distance radially beyond the outer surface of the package and in an unwinding direction, during the step of unwinding of the length of yarn from the package. This results in the formation of a yarn loop composed of a plurality of yarn windings, and the marking strip may then be applied onto the outer surface of the package within the loop. Also, the winding mandrel is then relatively rotated in the winding direction so as to rewind the yarn so as to overlie the marking strip.

The distance of the winding mandrel from the package surface should in this instance be at least so large that it does not obstruct the positioning of the marking strip on the package surface, which occurs within the yarn loop with the aid of a suitable device, and which secures the yarn end at the same time. The subsequent winding of yarn over the marking strip may then proceed, for example, in that the winding mandrel now releases—possibly when the package is stopped—by rotating back in the winding direction, from the yarn supply stored in the yarn loop, the amount of yarn which is required to form the yarn winds to be laid over the marking strip. Yarn that may possibly be left over from the yarn loop goes to waste.

Likewise in this instance, it is possible to use as marking strip a one-sided adhesive, adequately long strip of material, which is placed onto the package surface in the axial range to be wound by the yarn, so that its adhesive side is directed radially outward. Advantageously, it is prefolded approximately in its axial center. In any event, however, it is arranged so that its wound axial section can be glued and covered by an approximately equally long axial section, which remains uncovered during the winding, and is bent back after the winding.

Likewise, it is possible, for example, to use two substantially equally long strips of material as marking strips, of which at least one has adhesive on one side. One of the strips, for example, the adhesive one, is placed on the package surface with its adhesive side facing outward, and wound by the yarn. Then, after yarn has been wound thereover, the second strip is glued to the first strip. In doing so, one should take precautions that the adhesive side is by no means placed on the package, but contacts only the yarn winds which are wound over the marking strip.

Likewise in this instance, it is preferred to use marking strips which consist of the same polymers as the wound yarn, in particular of a PETP, PA, or PP film strip, which may later go, together with the stripped off yarn layers, to the recyclable waste.

If a marking strip is to be applied to packages, which have on their circumference a beadlike yarn accumulation formed and wound by the yarn end without being traversed, it will normally be necessary to remove these yarn accumulations before applying a marking strip and winding the yarn thereover. This may basically occur in that the yarn is unwound tangentially and removed by a suction device.

However, it should be considered that the beadlike yarn accumulation is formed, while a package wound at 6000 m/min. and having an end diameter of, for example, about 500 mm, slows down, so that until its standstill several hundred meters of yarn will normally accumulate, which require a considerable amount of time for their tangential unwinding. Therefore, it is preferred to remove the yarn suction device after having picked up the yarn end from the package surface, to then swing or deflect the suction device or even only the yarn to the extension of the package axis, and to swing it back overhead after the removal of the yarn accumulation, whereupon the above-described formation of the yarn loop starts.

In a further embodiment of the invention, the removal of the suction device from the package surface, and possibly the securing of the yarn end which starts to proceed automatically as the suction device moves away, are initiated by the signal of an optical yarn sensor which is installed in the inlet region of the suction device, the signal being generated upon detecting the beginning of the yarn entering into the suction device.

To carry out the method, the package is removed from the winding spindle upon completion of the winding cycle, and placed on a package receiving means with a mandrel which is rotatable preferably in both directions. Such a further developed device for carrying out the method of this invention offers in addition the advantage that the marking of the yarn end can proceed during the transportation of the package, for example, on a doffer.

An apparatus for carrying out the method of this invention comprises a package supporting mandrel for rotatably supporting a wound yarn package having an outer surface and so as to permit rotation of the package about the axis of the mandrel in either direction. A yarn suction device is positioned adjacent the mandrel so as to be adapted to receive the yarn end from the supported wound yarn package and withdraw a length of the yarn from the package while the package is rotated in an unwinding direction. Also, a device is provided for applying a marking strip onto the outer surface of the wound package after the length of yarn has been withdrawn therefrom by the yarn suction device, and such that the withdrawn length of yarn may be wound back onto the package and at least in part over the applied marking strip upon rotation of the package in a winding direction. In this apparatus, the device for cutting the yarn is advantageously arranged in front of the inlet opening of the yarn suction device.

An advantageous further development of the apparatus comprises a stand with a rotatable package mandrel for accommodating a package, a reel wheel spaced apart from the package surface and concentrically rotatable about the package axis, and having at least one winding mandrel aligned substantially parallel to the package axis, a yarn suction device, and—in particular when the method proceeds automatically—a device for applying a marking strip to the package surface. It should here be remarked that basically, in accordance with the invention, a marking strip may also be applied to the package by hand.

In a special embodiment of this apparatus, the reel wheel is provided with two or more arms connected to a hub rotatable about the package axis, the free ends of which carry each an axis parallel winding mandrel. In the place of the arms connected to the hub, it is also possible to use as a carrier of the winding mandrels a rotatably supported, circular-cylindrical reel wheel, which is coaxial with the package mandrel and arranged, for example, on the edge of a stationary circular disk arranged coaxially to the package axis. In this instance, the circular disk serving as a bearing may contain a cutout for the passage of the marking strip.

Preferably, the winding mandrels attached to the radial arms or to the circumference of the circular or annular surface are rotatably supported for easy motion, for example, in antifriction bearings. They may however also be constructed as rotatably supported sleeves, which are clipped onto projectingly mounted carrying mandrels. The advantage of this measure lies in that, both while winding the yarn reserve and while unwinding, the friction occurring on the winding mandrels is reduced due to the slip between the yarn and the mandrel surface. To this end, it may also be provided, if need arises, that the winding mandrels are driven, preferably as a function of the speed of the reel wheel.

In a typical embodiment of the apparatus in accordance with the invention, four winding mandrels are provided and arranged, so that the outline of the winding mandrels, when viewed in its cross section, is a square. Stated in other words, the winding mandrels form the edges of a cube. While any desired number of winding mandrels may be provided in a reel wheel, and the outline of the mandrel axes may be, when viewed in its cross section, a regular polygon with a corresponding number of sides, it is however limited in practice, as described below, by the requirement that the free spacing between adjacent winding mandrels be sufficiently large to permit the full package to be moved through the gap between adjacent winding mandrels. This spacing should preferably be by at least 10 to 15 mm larger than the package diameter.

Besides forming the yarn loop comprising several, for example, three to four yarn winds, the winding mandrels of the different embodiments have also the task of laying the yarn loop axially, so as to be able to secure the marking strip to be wound by the yarn at the predetermined point, in most cases in the vicinity of a package front end, i.e., so that the range of the marking strip to be wound by the yarn and the yarn loop lie in the region of the same normal plane relative to the package axis. With the use of straight winding mandrels having a constant cross section, this can be achieved by correspondingly arranged yarn guides. However, the winding mandrels may also be shaped such that they guide the yarn accordingly when a yarn loop is formed. To this end, they may consist, for example, of two slender truncated cones contacting each other with their tips, of bars with deformations extending in radial planes and forming at the desired point a radially outward open notch, or, when rotating the wheel, they may also be structures, each resembling helical springs and being driven in uniform direction of rotation with segments of opposite pitch meeting one another at the desired point.

In a simple embodiment, the reel wheel is freely rotatably supported on the package mandrel. Preferably however, the reel wheel and the package mandrel have each their own drive. In a preferred embodiment, both the package mandrel and the reel wheel have each their own stand, both being constructed in a further embodiment in such a manner and displaceable relative to one another so far that the axes of rotation of the package mandrel and the reel wheel coincide.

As already indicated above, it is possible to withdraw the yarn overhead even without pivoting the suction device, in that a suitable yarn guide is provided, for example, a vertical guide bar attached to the free end of an arm pivoting about a pin arranged on the base plate of the package stand. This yarn guide allows to deflect the yarn advancing into the suction device, so that the yarn unwinds overhead from the package.

To ensure an unobstructed application of the marking strip to the package surface, it is preferred to dimension the distance of the winding mandrels from the axis of the reel wheel such that the spacing between the yarn loop and the package surface is at no point of the package circumference smaller than about 50 mm, and preferably nowhere smaller than about 80 mm. Accordingly, for example, in an arrangement of four winding mandrels, same have preferably a distance from the package axis, which equals to at least 0.8 times of the package diameter.

BRIEF DESCRIPTION OF THE DRAWINGS

The invention will be described in more detail with reference to embodiments illustrated in the attached drawing, in which.

DETAILED DESCRIPTION OF THE PREFERRED EMBODIMENTS

Figure 1:
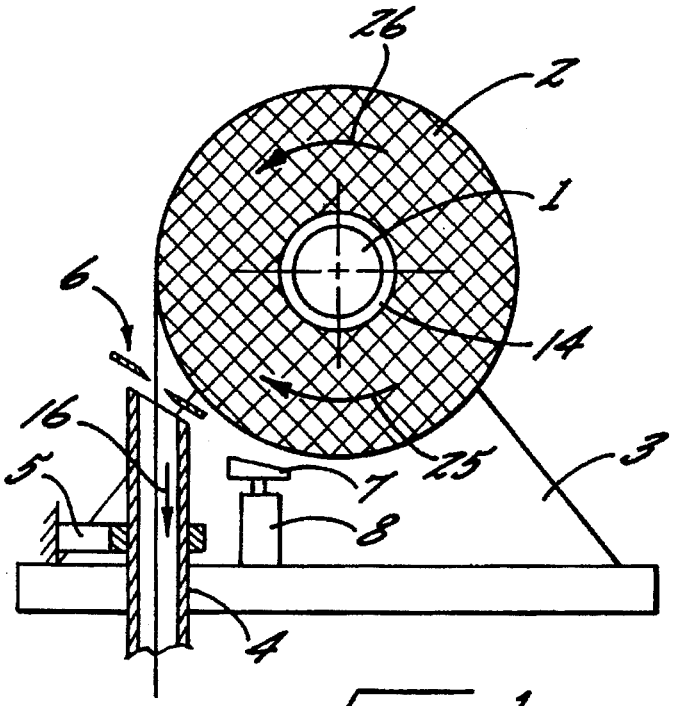
FIG. 1 illustrates an embodiment of the apparatus in accordance with the invention with a device for applying a marking strip arranged in front of the suction device.

In the embodiment shown in FIG. 1, the package receiving device consists of a stand or block 3 with a package receiving mandrel 1. Associated to the package receiving device 1, 3 is a yarn suction device 4.

A package 2 is inserted on package receiving mandrel 1. The yarn suction device 4 which is operative in direction 16, may for example be arranged such that the extension of the suction tube axis is tangent to the package circumference substantially in the narrow axial range of the package surface, as may be found in one or the other takeup device, in which range the yarn is deposited toward the end of the winding cycle, after it has been lifted out of the traversing mechanism. Arranged in front of the inlet opening of yarn suction device 4 is a yarn cutting device 6.

In the direction of winding and preceding yarn suction device 4, the embodiment of FIG. 1 is provided with a device 7–8 for applying marking strips to the package surface. As indicated in the illustration, this device may for example consist of a drive cylinder 8 and a stamp 7. Devices known as noncontacting labeling machines have shown to be suitable for the noncontacting application of marking strips.

Figure 2:
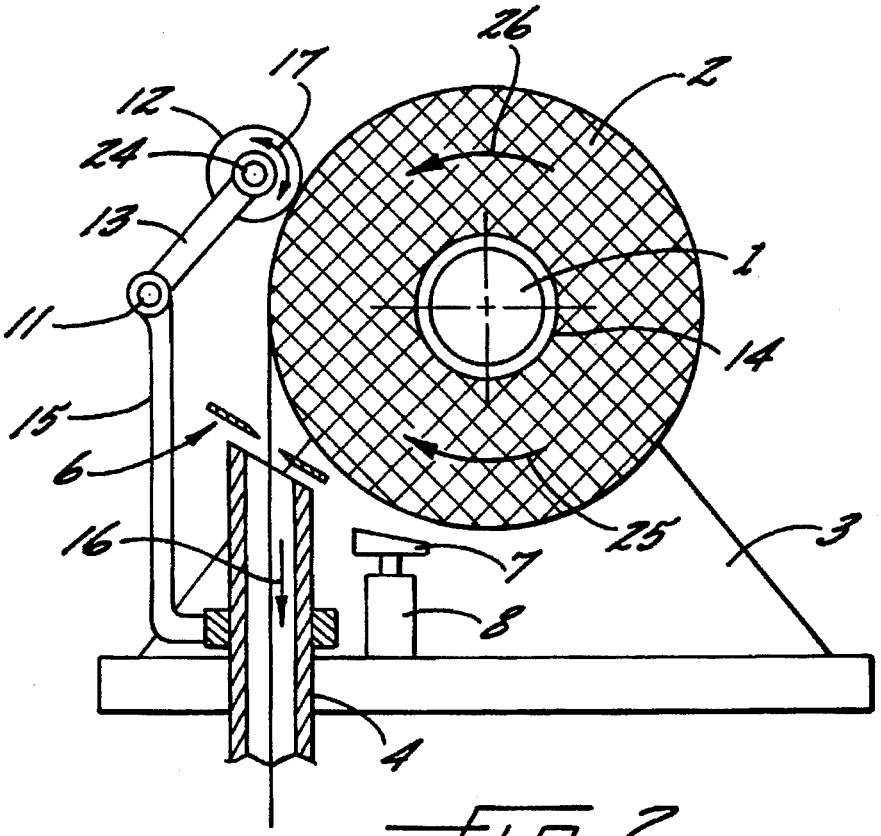
FIG. 2 illustrates an embodiment corresponding to FIG. 1, however, with a driven contact roll.

Shown in FIG. 2 is the same embodiment of the apparatus in accordance with the invention as in FIG. 1. However, in this embodiment, the yarn suction device 4 is connected, via a support 15, a pivot bearing 11, and an arm 13 carrying a roll 12, which serves in particular to press against the marking strip the yarn end that has been pulled out of yarn suction device 4 for rewinding. Moreover however, the roll 12 may also be rotatable in both directions, as is indicated by arrow 17, so as to be able to drive the package 2 in direction of unwinding 26 and direction of winding 25, when carrying out the method of the present invention.

In FIG. 2, yarn suction device 4 and contact roll 12 are interconnected. However, it should be understood that they may also be provided separated from one another, and be, for example, movable, or connected with block 3.

With respect to the two illustrations, it should be noted that the device 7–8 for applying the marking strips may also be provided between yarn suction device 4 with yarn cutting device 6 and contact roll 12, namely behind yarn suction device 4, when viewed in the direction of winding.

Furthermore, the roll arm 13 may be pivoted by a cylinder-piston assembly, and be moved away from the winding surface during the winding cycle.

Figure 3:
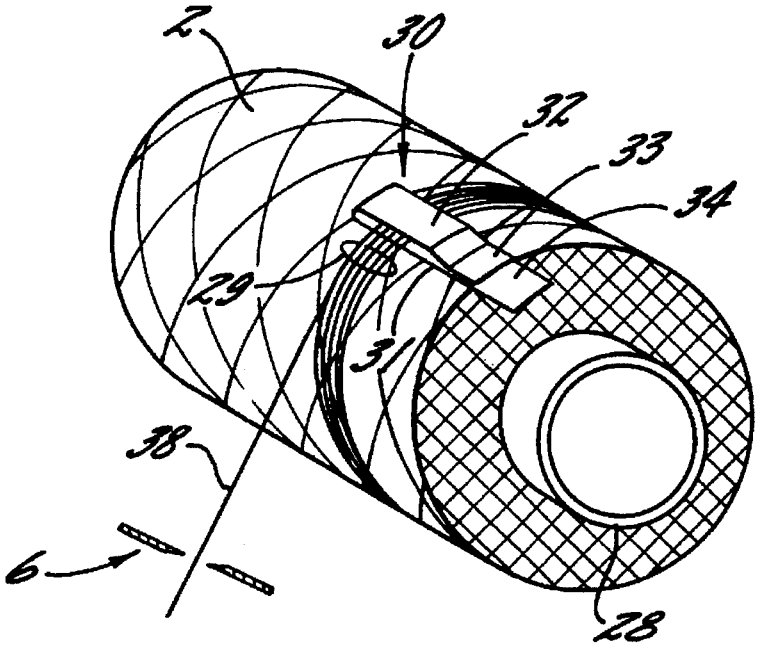
FIG. 3 illustrates a package with a special embodiment of the marking strip.

In the embodiment of FIG. 3, a marking strip 30 consisting of an adhesive tape is applied, when package 2 in its winding position has reached the end of the winding cycle, when package 2 decelerates, or—when package 2 is removed—before or during the rewinding of unwound yarn end 38, to the package surface, possibly with its adhesive side radially outward, and preferably with a projecting end portion 34, so that its front end extends somewhat, for example, by half the length of the adhesive tape, beyond range 29, in which the yarn advances to the package. In addition, the opposite end portion 32 of the strip 30 extends beyond winding range 29 and is folded over the edge of winding range 29, by hand and after the package is stopped, and its end 33 is pressed against underlying strip segment 31 and glued to same, when an adhesive tape is used. It should be remarked that it is possible to even use, when selecting a corresponding material and adequate width, a nonadhesive marking strip, which retains its folded-over state due the curvature of the package surface.

Figure 4:
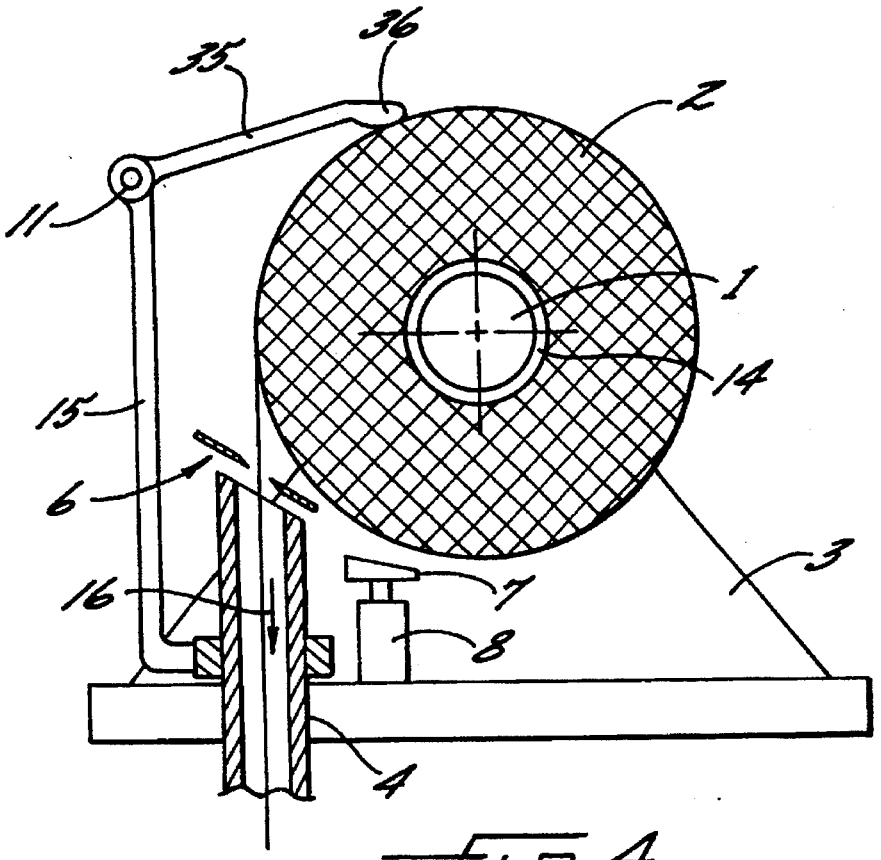
FIG. 4 illustrates an embodiment in accordance with FIG. 2, however, with a contact shoe in the place of the contact roll.

Shown in FIG. 4 is an embodiment of the apparatus in accordance with the invention, which corresponds essentially to the embodiment of FIG. 2. In the place of roll arm 13 and roll 12 rotatably mounted on the free end thereof, the free end of the arm is provided in this instance with a contact lever 35 carrying a guide shoe 36. Although in the illustrated embodiment, the guide shoe 36 contacts the package surface only by its own weight, it its however possible to press, in the same manner as contact roll 12, the guide 36 shoe against the package surface in addition by weights or a cylinder-piston unit not shown in detail.

Figure 5:
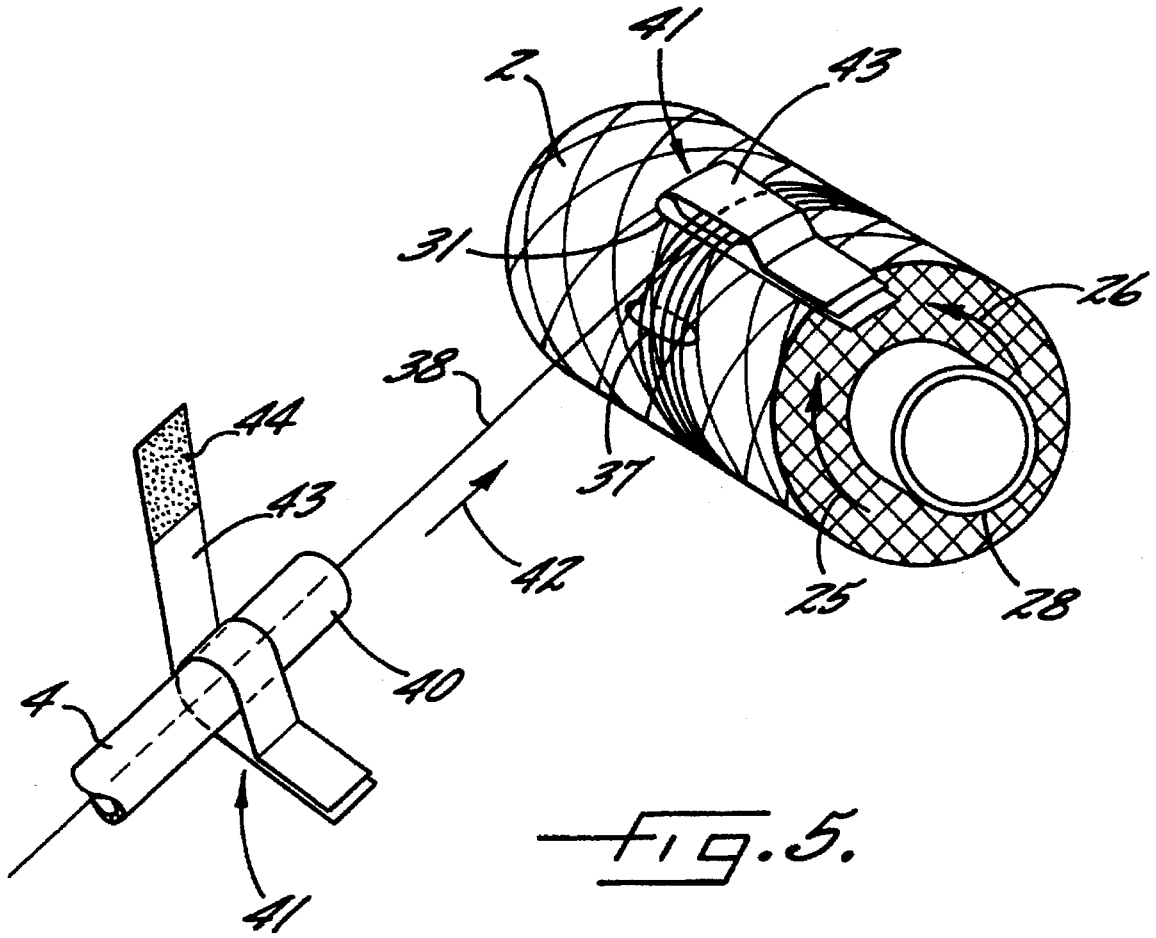
FIG. 5 illustrates a marking strip formed to a loop for purposes of showing the application and securing of the yarn end winding.

A marking loop 41 shown in FIG. 5 is similar to that shown in FIG. 3. It is slipped over the suction nozzle 40 of a suction gun, before yarn end 38 is sucked into yarn suction device 4, and after the yarn is transferred, it is pushed in direction of arrow 42 toward package 2, placed on the circumference thereof, so that its end remains seizable, and wound several times by the yarn (yarn winds 37). Thereafter, the yarn 38 is cut. As shown in FIG. 5, this embodiment allows, upon placing the loop 41 on the package, to secure the yarn windings 37 which are formed in this yarn section when winding the yarn over the loop. To this end, an additional strip or tab 43 is attached to the outer circumference of the loop curvature, which has at least one adhesive portion 44 on the inner side of its free end. After winding the yarn over the loop lying on the package surface, the tab 43 is placed over windings 37, and the adhesive portion 44 is glued to the underlying end portion of the loop 41.

Figure 6:
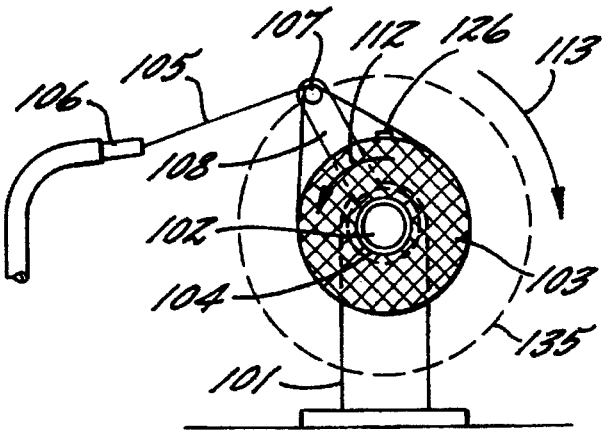
FIG. 6 is a front view.
Figure 7:
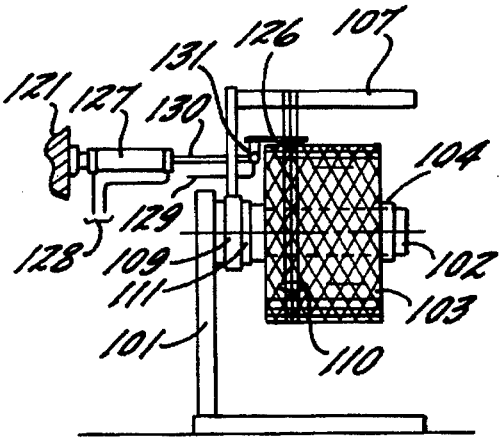
FIG. 7 is a side view of a reel wheel with one winding mandrel.

FIGS. 6 and 7 are a front and a side view of an apparatus with a common stand 101 and a package mandrel 102 mounted thereon carrying a rotatable package 103. A reel wheel 108 equipped with only one winding mandrel 107 is supported on the package mandrel by means of a hub 109 arranged between stand 101 and a spacer 111 for free rotation about package mandrel 102. The winding mandrel 107 defines an axis which is parallel to the axis of the mandrel 102, and it may comprise a cylindrical bar or a sleeve rotatably supported thereon.

While package 103 is rotated by means not shown in an unwinding direction indicated by arrow 112, the mandrel 107 of reel wheel 108 moving along a circle 135 forms a yarn loop 110 consisting of three or four yarn winds, as it rotates in the opposite direction indicated by arrow 113. Subsequently, the package 103 and reel wheel 108 are stopped.

A device which is shown in FIG. 7 as a cylinder-piston unit 127, 130 supplied via lines 128 and carrying on its free end a suction cylinder 131 actuated via a supply line 129, allows to apply to the package surface and to release a marking strip 126 within the yarn loop 110 surrounding winding mandrel 107 (note FIG. 6) with its adhesive side facing upward. Thereafter, reel wheel 108 rotates back in direction of arrow 112, and in doing so, the marking strip 126 is wound by winding back the yarn material stored in yarn loop 110. Finally, the portion of marking strip 126 extending toward stand 101 is folded toward the package center and glued to the wound portion of the strip.

Figure 8:
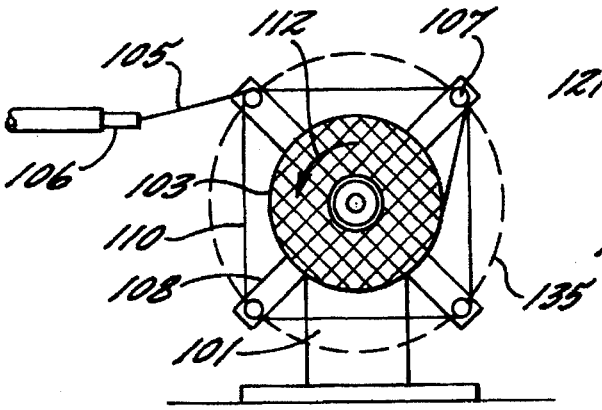
FIG. 8 is a front view.
Figure 9:
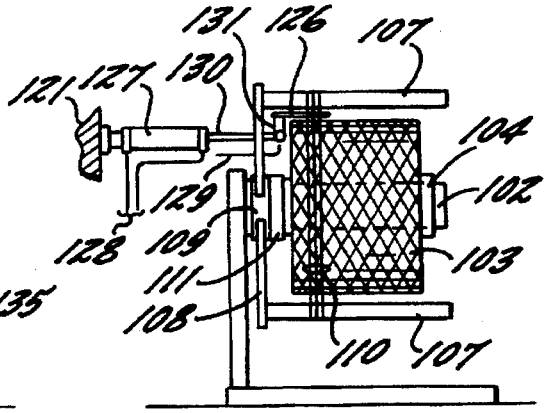
FIG. 9 is a side view of a reel wheel with four winding mandrels.

FIGS. 8 and 9 illustrate a comparable apparatus of the present invention, which differs from that described above in that the rear wheel 108 comprises four spoke like arms attached to the hub 109, which accommodate each on their free ends a winding mandrel 107 arranged in a circle 135. The arrangement is regular, and the contour of winding mandrels 107 has the shape of a square, as can be noted from FIG. 8.

At this point, it should be remarked that any desired number of winding mandrels 107 may be mounted on a reel wheel 108. However, they should be arranged in a circle 135, so that they are equally spaced apart from one another. Preferred are embodiments with no more than six to eight winding mandrels.

Figure 10:
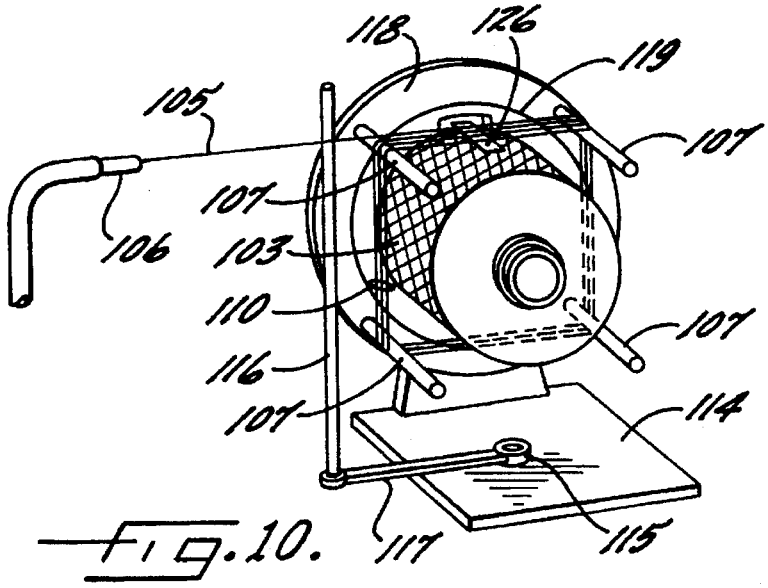
FIG. 10 shows a rotatably supported, annular reel wheel coaxial with the package mandrel.

Shown in FIG. 10 with four winding mandrels 107 is a reel wheel 118, which has the shape of an annulus. The reel wheel is rotatably supported in a manner not shown on the edge of a stationary circular disk 119 with its center extending coaxially with the axis of the package. The circular disk 119 shows above package 103 an opening for applying marking strip 126.

The apparatus of FIG. 10 is further provided with a device 115–117, which allows to move yarn 105 taken in by a suction device 106 for unwinding a (no longer present in the illustration) bead-shaped yarn accumulation 134 (FIG. 11) into the region of the package axis. In the illustration, the device is shown in simplified manner as a vertically aligned bar 116, which is attached to the free end of a rocker arm 117, and can be pivoted with same about a pivot bearing 114 provided in base plate 115 of stand 101. The yarn 105 advancing into the suction device 106, which has been moved away from package 103 after seizing the yarn 105, is deflected by pivoting bar 116 in front of package 103, while suction device 106 remains stationary, so as to permit to unwind yarn bead 134 overhead.

Figure 11:
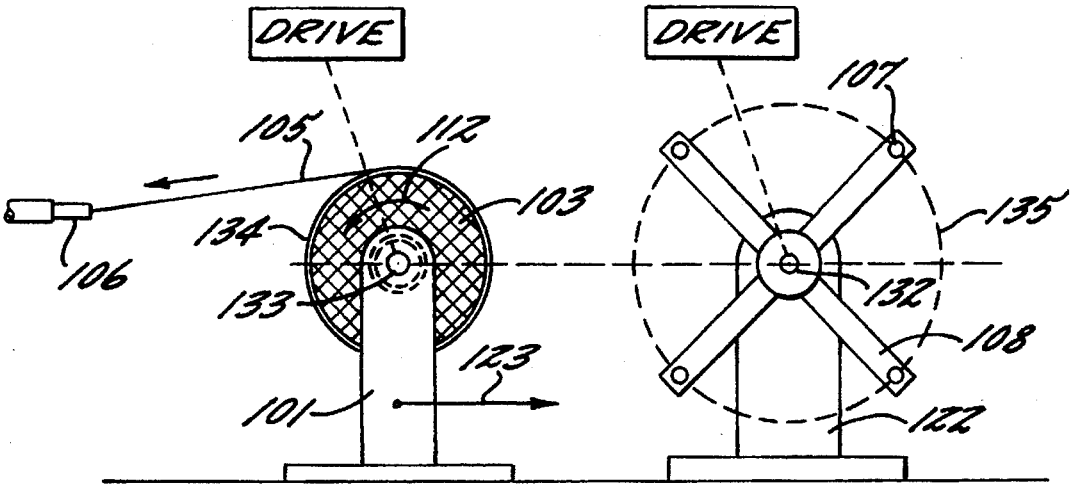
FIG. 11 is a front view of a package and reel wheel which are mounted on separate stands and which are movable relative to each other.
Figure 12:
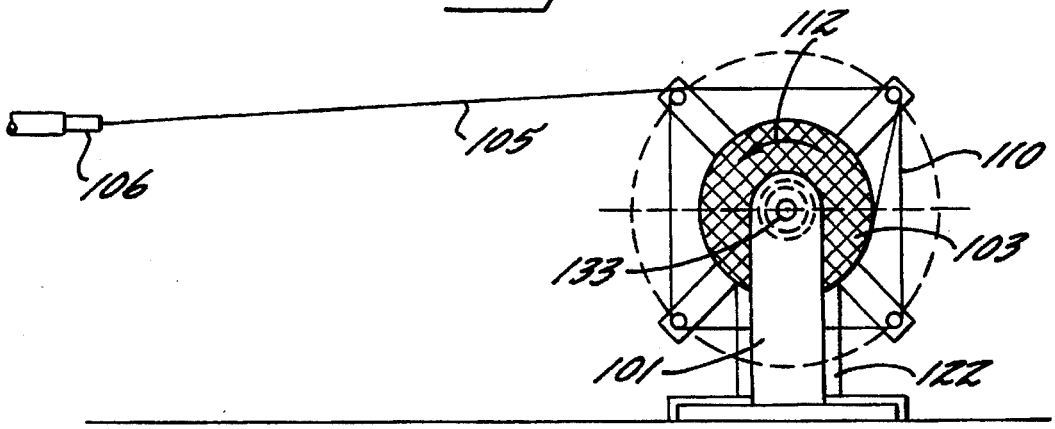
FIG. 12 is a view similar to FIG. 11 but illustrating the package and reel wheel moved to their operative position.
Figure 13:
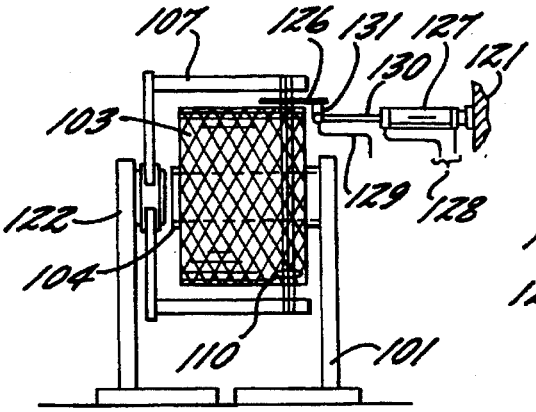
FIG. 13 is a side view of the package and reel wheel shown in FIG. 12.

FIGS. 11–13 show a further embodiment of an apparatus in accordance with the invention. It differs from those described above in particular in that the package mandrel 102 receiving package 103 by its tube 104, and reel wheel 108, which is here equipped with four winding mandrels, possess each its own stand 101; 122, and that the two stands 101, 122 are displaceable relative to one another. Of FIGS. 11–13, FIG. 11 illustrates the start of the measures taken to secure yarn end 105 by marking, FIG. 12 the formation of yarn loop 110, and FIG. 13 the application of the marking strip In FIG. 11, the package stand 101 with package 103 is located between suction device 106 and reel wheel 108 with stand 122. The suction device 106 has seized yarn end 105 (see FIG. 10) and unwinds yarn bead 134 which was wound without traversing mechanism. In the illustration, this proceeds tangentially. Preferred, however is a working method as described above with reference to FIG. 10. Once the unwinding of yarn bead 134 is completed, package 103 is displaced by moving stand 101, as shown in FIG. 12, relative to reel wheel 108, so that package axis 133 and reel wheel axis 132 coincide, and that furthermore winding mandrels 107 axially cover package 103, as shown in FIG. 13. This is possible, since the free spacing between adjacent winding mandrels 107 is larger than the package diameter.

As already mentioned further above, the furnishing of reel wheel 108 with four winding mandrels 107 is arbitrary. Basically, any number may be used, starting with one winding mandrel 107, it being however common practice not to exceed a number of six to eight, in particular in embodiments as shown in FIGS. 11–13. While maintaining a large enough spacing between mandrels 107, a larger number thereof might however cause problems with the dimensioning of the reel wheel.

Now, a yarn loop 110 is formed, in that while package 103 further rotates in direction of arrow 112, and while possibly the removal of yarn end 105 by suction device 106 is maintained, the reel wheel 108 is rotated oppositely to the direction of rotation indicated by arrow 112.

FIG. 13 illustrates the engaged position. The yarn loop 110 is wound, and reel wheel 108 and package 103 are stopped. Now—in this instance with the aid of a cylinder-piston unit 127, 130, which is anchored to frame 121 of the apparatus, and carries on the free end of piston rod 130 suction head 131 for retaining the marking strip—the marking strip 126 is applied to the package surface. By reversing the rotation of reel wheel 108, now in direction of arrow 112, yarn is wound several times over the marking strip 126, which may still be retained by devices 127, 130, 131, if need be. Subsequently—not shown—the end of the strip projecting beyond the package front end is folded and glued to the wound portion of marking strip 126. The cylinder-piston unit 127, 130 is supplied via lines 128, the suction head 131 via suction line 129.

Figure 14:
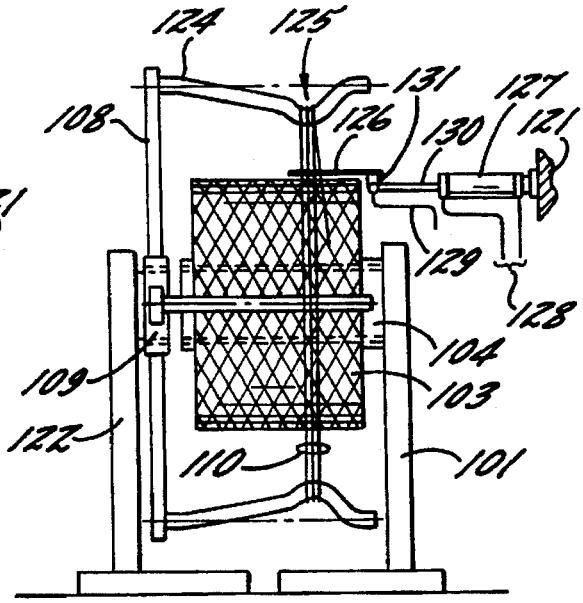
FIG. 14 shows a similar embodiment as FIGS. 11–13, however, with spatially deformed winding mandrels.

FIG. 14 is an illustration comparable with that of FIG. 13 and depicts an embodiment of reel wheel 108, in which winding mandrels 124 are shaped such that the yarn loop 110 is formed automatically by guiding the yarn accordingly in the axial region of package 103, in which yarn is to be wound over marking strip 126. To this end, the winding mandrels 124 are bent radially inward over the largest portion of their length, and each forms above the winding point a notch 125 for retaining yarn loop 110.

Other shapes of winding mandrels 107 are possible. For example, they may consist of two slender truncated cones interconnected at their tips—if need be, via an inserted, short circular-cylindrical segment—or they may be structures similar to helical springs mounted on the reel wheel for rotation about their own axis with segments having an opposite pitch meeting at the point designated to receive yarn loop 110. The rotary drive operating in the same direction for all mandrels 107 and necessary to relocate the yarn loop may be realized, for example, when a drive cord is provided, which is guided over a pulley arranged on stand 122 and extending coaxially with reel wheel axis 132, and over corresponding cord pulleys on the rotatably supported mandrel ends, by rotating reel wheel 108, it being necessary that the pitch of the screw threads be directed each oppositely to the direction of rotation. With the use of an uncrossed cord, it would be necessary that the pitch of the screw threads, each as viewed from the mandrel ends toward the point of coincidence, extend in the direction of rotation of reel wheel 108. This allows to reduce the friction occurring during the relative movement of yarn 105 on mandrels 107. To this end, the mandrel 107 projecting from reel wheel 108 is rotatably supported or constructed as a rotatably supported sleeve.

What is claimed is:

1. A method of winding a yarn into a wound package and comprising the steps of:

winding an advancing yarn onto a rotating core so as to form a wound package having an outer surface, terminating the rotation of the wound package, unwinding a limited length of the yarn from the wound package, then applying a marking strip onto the outer surface of the wound package, and rewinding the limited length of the yarn back onto the package and so as to at least in part overlie the marking strip.

2. The method as defined in claim 1 wherein the step of unwinding a limited length of the yarn from the wound package includes drawing the yarn into a yarn suction device, and wherein the step of rewinding the limited length of the yarn back onto the package includes withdrawing the yarn which has been drawn into the yarn suction device therefrom.

3. The method as defined in claim 1 wherein the step of rewinding the limited length of the yarn back onto the package includes rewinding the yarn within a relatively narrow axial range, and wherein the step of applying a marking strip onto the outer surface of the wound package includes applying a marking strip having a first end portion which underlies the axial range and an opposite end portion which extends beyond the axial range, and comprising the further step of folding the opposite end portion so as to overlie the first end portion.

4. The method as defined in claim 3 comprising the further subsequent steps of adhering the opposite end portion of the marking strip to the first end portion thereof.

5. The method as defined in claim 1 wherein the marking strip is in the form of a loop, and wherein the unwinding step includes drawing the limited length of the yarn from the wound package through the loop, and wherein the step of applying a marking strip onto the surface of the wound package includes advancing the loop to the outer surface of the package, and such that the rewinding step includes rewinding the limited length of the yarn so as to at least in part overlie the loop.

6. The method as defined in claim 5 wherein the step of rewinding the limited length of the yarn back onto the package includes rewinding the yarn within a relatively narrow axial range, and wherein the marking strip includes a second segment adhered to the loop, and which is disposed outside of the axial range of the rewound yarn which overlies the loop, and comprising the further step of folding the second strip over the axial range of the rewound yarn and the loop and adhering the same to the loop.

7. The method as defined in claim 1 wherein the marking strip comprises an adhesive coating on one surface thereof, and wherein the step of applying a marking strip onto the outer surface of the wound package includes positioning the marking strip with the adhesive coating facing outwardly.

8. The method as defined in claim 1 wherein the advancing yarn comprises a polymer and wherein the marking strip comprises a plastic material composed of the same polymer as the wound yarn, so as to permit the marking strip to be subsequently deposited along with the stripped off yarn windings as recyclable waste.

9. The method as defined in claim 1 wherein the unwinding step includes rotating at least one winding mandrel circumferentially about the wound package at a distance radially beyond the outer surface of the package, and in an unwinding direction and so as to form a yarn loop composed of a plurality of yarn windings, and wherein the step of applying a marking strip onto the surface of the wound package includes placing the marking strip within the loop, and wherein the rewinding step includes relatively rotating the at least one winding mandrel circumferentially about the wound package in the winding direction of the yarn.

10. The method as defined in claim 9 wherein the step of winding an advancing yarn onto a rotating core includes traversing the advancing yarn so as to form a cross wound package and then terminating the traverse so as to form a circumferential yarn accumulation that is formed within a relatively narrow axial range on the outer surface of the wound package, and wherein the step of unwinding a limited length of the yarn from the yarn package includes removing the yarn accumulation in an axial direction from the yarn package.

11. The method as defined in claim 10 wherein the step of removing the yarn accumulation in an axial direction from the yarn package includes drawing the yarn into a yarn suction device, and deflecting the yarn as it is drawn into the yarn suction device so that the yarn is withdrawn from the yarn accumulation in an axial direction.

12. The method as defined in claim 9 wherein the step of rotating at least one winding mandrel circumferentially about the wound package includes also rotating the wound package in the unwinding direction.

13. An apparatus for applying a marking strip to a wound yarn package comprising:

a package supporting mandrel for rotatably supporting a wound yarn package having an outer surface and so as to permit rotation of the package about the axis of the mandrel in either direction, a yarn suction device positioned adjacent the mandrel so as to be adapted to receive the yarn end from the supported wound yarn package and withdraw a length of yarn from the package while the package is rotated in an unwinding direction, and a device for applying a marking strip onto the outer surface of the wound package after the length of yarn has been withdrawn therefrom by the yarn suction device.

14. The apparatus as defined in claim 13 further comprising a yarn cutting device mounted adjacent the yarn suction device.

15. The apparatus as defined in claim 14 wherein the yarn suction device includes a yarn inlet opening, and wherein the yarn cutting device is mounted immediately adjacent the yarn inlet opening of the yarn suction device.

16. The apparatus as defined in claim 13 further comprising a reel wheel mounted coaxially to the package supporting mandrel and so as to be separately rotatable with respect thereto, said reel wheel including at least one winding mandrel positioned at a location radially spaced from the package supporting mandrel and extending generally parallel to the axis of the package supporting mandrel and so as to be radially spaced from the outer surface of the wound yarn package supported thereon.

17. The apparatus as defined in claim 16 further comprising a support stand rotatably supporting said package supporting mandrel so that the supporting mandrel has a free end, and a yarn deflecting guide bar pivotally mounted to said support stand for movement between a first position disposed perpendicular to and radially spaced from the axis of the package supporting mandrel, and a second position disposed perpendicular to and substantially intersecting the axis of the package supporting mandrel adjacent the free end of the supporting mandrel.

18. The apparatus as defined in claim 16 further comprising drive means for separately rotating the package supporting mandrel and the reel wheel about the axis of the package supporting mandrel.

19. The apparatus as defined in claim 16 wherein the package supporting mandrel is mounted on a first stand, and wherein said reel wheel is mounted on a second stand, and wherein said first and second stands are relatively movable between a first position wherein the stands are laterally separated and a second position wherein the axis of the package supporting mandrel and the rotational axis of the reel wheel are coaxial.

20. The apparatus as defined in claim 16 wherein said at least one winding mandrel of said reel wheel is radially spaced from the package surface a distance less not than about 80 mm.

21. The apparatus as defined in claim 16 wherein said reel wheel includes four of said winding mandrels positioned to form the edges of a cube, and with the four mandrels each being spaced from the axis of the package supporting mandrel a distance which is at least equal to about 0.8 times the diameter of the wound package.

22. The apparatus as defined in claim 16 wherein the reel wheel includes a plurality of said winding mandrels which define a regular polygon, and wherein the spacing between adjacent winding mandrels is at least 10 mm greater than the package diameter.

23. The apparatus as defined in claim 22 wherein the winding mandrels are mounted for free rotation about their respective axis.

24. The apparatus as defined in claim 22 wherein the winding mandrels each define a yarn guiding notch at a medial location along its length.

25. A wound yarn package which defines an outer surface, and includes a marking strip applied onto the outer surface, and with a length of the yarn adjacent the yarn end being wound onto the package to at least in part overlie the marking strip, wherein the marking strip includes a loop, and wherein the length of yarn adjacent the yarn end includes a first winding extending through the loop and additional windings positioned at least in part to overlie the loop.

* * * * *